United States Patent [19]

Hastings et al.

[11] 4,294,411

[45] Oct. 13, 1981

[54] ELECTROSTATIC SPRAY GUN

[75] Inventors: Donald R. Hastings, Elyria; Martin J. Harjar, Vermilion, both of Ohio

[73] Assignee: Nordson Corporation, Amherst, Ohio

[21] Appl. No.: 55,020

[22] Filed: Jul. 5, 1979

[51] Int. Cl.[3] ..... B05B 5/02

[52] U.S. Cl. ..... 239/707; 239/415; 239/528

[58] Field of Search ..... 239/3, 690–708, 239/414, 415, 526–528; 285/239

[56] References Cited

U.S. PATENT DOCUMENTS

| | | | |
|---|---|---|---|
| 2,991,940 | 7/1961 | Dupler et al. | 239/527 X |
| 3,367,578 | 2/1968 | Juvinall et al. | 239/705 |
| 3,583,632 | 6/1971 | Shaffer et al. | 239/705 |
| 3,966,238 | 6/1976 | Washkewicz | 285/239 |
| 4,123,007 | 10/1978 | Gardner | 239/527 X |
| 4,182,490 | 1/1980 | Kennon | 239/3 |

FOREIGN PATENT DOCUMENTS

| | | | |
|---|---|---|---|
| 2267154 | 11/1975 | France | 239/527 |
| 925099 | 5/1963 | United Kingdom . | |
| 1341524 | 12/1973 | United Kingdom . | |
| 1450833 | 9/1976 | United Kingdom . | |

*Primary Examiner*—Andres Kashnikow

*Attorney, Agent, or Firm*—Wood, Herron & Evans

[57] ABSTRACT

An improved electrostatic spray gun, particularly of the hand-held type, is disclosed including an electrically insulative barrel and nozzle assembly, an electrically insulative air valve module mounted to the rear of the barrel assembly and externally thereof, and an electrically conductive metal handle assembly enclosing the rear end of the barrel and the air valve module. A charging electrode protrudes from the discharge orifice of the nozzle assembly. The flow of air through the barrel and nozzle assembly is controlled by a trigger which actuates the air valve. Actuation of the air valve in turn controls a needle and seat valve assembly close to the discharge orifice of the nozzle assembly to control the flow of coating material through the gun. A resistor is disposed inside the needle valve immediately upstream of the charging electrode. The elements of the electrostatic spray gun of this invention cooperate to provide a simple, lightweight, balanced gun having a high degree of reliability and repairability and clean and safe operation.

20 Claims, 5 Drawing Figures

ELECTROSTATIC SPRAY GUN

CROSS-REFERENCE TO RELATED APPLICATIONS

This invention is related to the electrostatic coating apparatus disclosed in U.S. Ser. No. 971,514, filed Dec. 20, 1978, and U.S. Ser. No. 021,197, filed Mar. 16, 1979, both in the name of Donald R. Hastings and both assigned to the assignee of this invention.

BACKGROUND OF THE INVENTION

This invention relates to electrostatic spray systems, and, more specifically, to hand-held electrostatic spray guns.

Electrostatic spray coating is an established art. In conventional electrostatic spray coating systems, a fluid coating material such as paint, varnish, lacquer and the like is projected toward an object to be coated in an atomized or particulate form from a dispensing device. The object to be coated is held at electrically ground potential and either just before, at, or just after being dispensed from the gun, the coating material is imparted an electrical charge so that it will be electrostatically attracted toward the object to be coated.

In such systems, a typical form of dispensing device is an electrostatic spray gun which is held in hand by an operator who moves the gun to deposit a uniform, smooth coating on the surface of the object. In such hand-held guns, it is highly desirable that the gun be lightweight and compact and that it be evenly balanced so that it may be held by an operator for extended periods of time without tiring the operator. It is also highly desirable that the gun have good transfer efficiency and a high degree of reliability as well as repairability.

That is, in normal operation, the coating material such as paint tends to wear various parts of the gun such as the air valve assembly controlling the flow of atomizing and fan-shaping air through the gun. This is a particular problem in electrostatic spray systems because the paint tends to be attracted to the gun itself thereby getting inside the gun where its abrasive nature can cause wear of valve parts. When valve parts begin to wear, they begin to leak and the gun loses efficiency. Prior art guns because of complicated structure and internal valving were not always easily repairable. Therefore, repair would require removal of the gun from operation for what might be extended periods of time.

Because of the high voltage involved in electrostatic spray coating, certain safety precautions must also be observed in the construction and operation of electrostatic coating devices. For example, when spraying many of the coating materials in use today, including powders, a flammable atmosphere results in the area of coating operation. The high voltage electrostatic charging circuit through the gun causes energy to be capacitively stored in the metallic components of the gun. Thus, if the gun is brought too close to any grounded object, the possibility arises that a spark will jump between the high voltage circuit in the gun and the grounded object igniting the flammable atmosphere in the coating area. The amount of this capacitively stored energy increases as the square of the voltage.

SUMMARY OF THE INVENTION

It has been among the principal objects of this invention to provide an improved electrostatic spray gun which is simple in construction, lightweight, compact and better balanced than electrostatic spray guns heretofore commercially available. For example, commercially available guns typically have weighed in the range of about 31 ounces. The electrostatic spray gun of this invention is substantially lighter weighing only about 22 ounces. This decrease in weight will be of significant benefit to operators who must hold the gun with an outstretched hand and arm over extended periods of time.

It has been a further objective of this invention to provide an improved electrostatic spray gun having a high degree of reliability and repairability. To this end, the electrostatic spray gun of this invention is relatively simple in construction having all internal operation along essentially one axial passageway and having an air valve module releasably mounted externally of the barrel assembly of the gun. This air valve module may be removed as a unit from the gun and immediately replaced with another module permitting operation to continue with only a very limited interruption. The valve may then be repaired at leisure. Accordingly, with the electrostatic spray gun of this invention, it is not necessary to remove the gun from operation for substantial periods of time to repair or replace worn parts. The simplicity of the gun as well as its modular construction provides the gun with a relatively high degree of reliability and repairability. The electrostatic spray gun of this invention is also capable of safely operating at relatively high voltages with reduced capacitively stored energy. That is, the gun has a resistor in the nozzle of the gun closely adjacent to the material charging electrode projecting from the nozzle which with a resistor in the barrel assembly is effective in damping out all the stored energy in the gun "upstream" of the resistor in the nozzle leaving only a small amount due to the electrode itself. As a result, the gun is capable of safely operating at relatively high voltages which reduced capacitively stored electrical energy. The gun is also provided with a material flow control valve close to the material discharge orifice to minimize the amount of paint left in the gun downstream of the nozzle between spray operations to provide for clean operation as well as to provide ease of access to the material flow control valve for inspection, maintenance and repair or replacement.

It has been a still further objective of this invention to provide such an improved electrostatic spray gun which is simple in construction and easy and economical to manufacture.

These and other objects of this invention are achieved by providing an improved electrostatic gun having a new and unique combination of modular components. In accordance with a presently preferred form of this invention, the gun includes an electrically insulative barrel assembly with a high voltage electrical path in it and an electrically insulative nozzle assembly attached to the forward end of the barrel portion. The nozzle assembly is made of a substantially non-conductive material having an annular fluid passage ending in a discharge orifice in the forward end of the nozzle and having a cone-shaped valve seat formed inside the nozzle close to the discharge orifice. The nozzle fluid passage is substantially axially aligned with and communicates directly with the material flow passageway in the barrel of the gun.

An air valve module is releasably attached to the rear end of the barrel assembly externally thereof. The air valve module can be quickly and easily removed and replaced. The air valve module communicates with an air flow passageway in the barrel of the gun. Flow of air to the air cap at the forward end of the gun is controlled by a trigger actuated valve stem in the air valve module which is axially slidable in the air valve module. The valve stem is operably connected at the rear end of the barrel to a pull rod which is axially slidable in the material flow passageway in the barrel of the gun. The pull rod is connected to a needle which in turn terminates at its forward end in a coned-tip seated on the nozzle valve seat. Movement of the air valve stem upon actuation by the trigger thus indirectly controls movement of the needle and thus the flow of material through the barrel of the gun and out the discharge orifice.

The needle includes a resistor inside its forward end and a thin wire-like electrode extending therefrom. The electrode extends through the discharge orifice and thus lies in the stream of material being discharged from the nozzle. The resistor is connected to the high voltage electrical path passing through the barrel of the gun by means of a metal spring which forms the electrical connection while permitting axial movement of the needle in a forward and rearward direction in the material flow passageway.

The path of high voltage charging circuit through the gun is thus through the barrel of the gun through a small electrode connecting the path to the spring and through the spring to the resistor in the forward end of the control rod to the charging electrode projecting out of the discharge orifice. The resistor in the forward end of the control rod and that in the electrical path in the barrel effectively damp out the capacitively stored energy of the gun rearwardly or "upstream" of the charging electrode. Thus, all the stored energy in the gun is damped out except for a small amount due to the electrode itself.

The present invention has eliminated many of the internal passageways typically found in commercially available guns particularly in the handle portion of the gun thereby providing manufacturing advantages in addition to the other advantages of the gun set forth above. The present invention further includes improved connection of the coating material and air flow paths with external supply sources as well as improved mounting of the needle of the material flow control valve assembly to the pull rod in the material flow passageway.

Other objects and advantages of the present invention will be apparent from the following detailed description of the invention taken with the accompanying drawings.

DETAILED DESCRIPTION OF THE INVENTION

Figure 1:
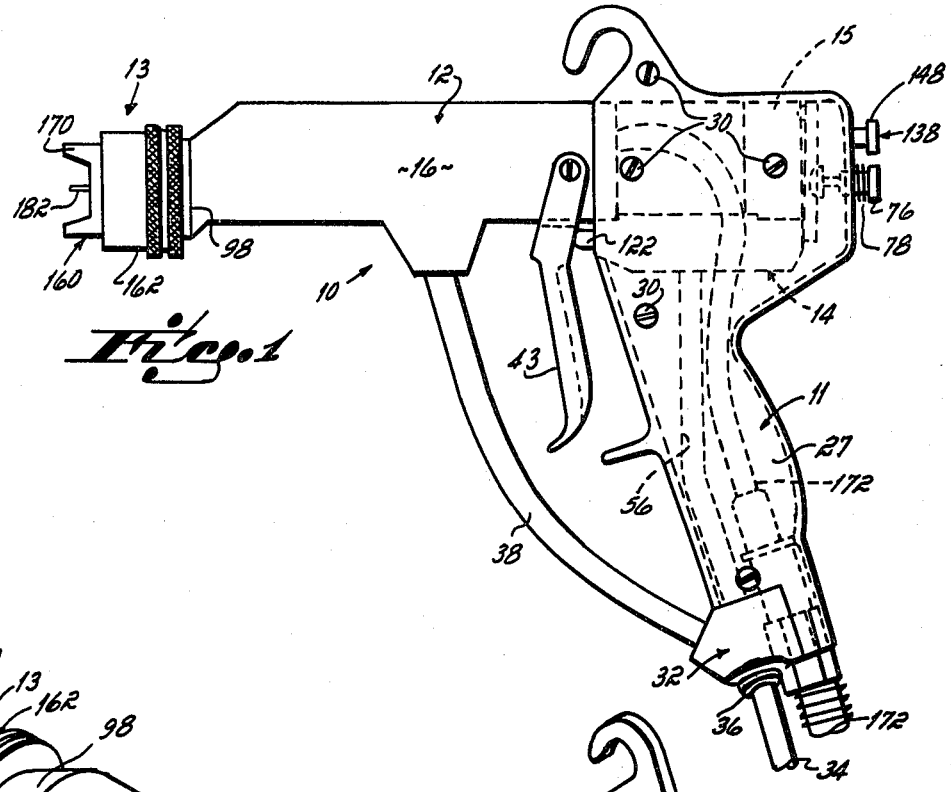
FIG. 1 is a side elevation view of the electrostatic spray gun of this invention.

The gun 10 illustrated in the drawings in an air operated electrostatic spray gun which relies upon the impact of an air stream with a liquid stream to effect atomization of the liquid stream. While the invention is described as applied to an air gun, it should be understood that it is equally applicable to all electrostatic spray guns.

The gun 10 comprises an electrically grounded handle assembly 11, an electrically insulative barrel assembly 12, an electrically insulative nozzle assembly 13 at the forward end of the barrel 12, and an electrically insulative air valve module 14 at the rear end 15 of the barrel.

The barrel assembly 12 is relatively simple in construction having essentially just three internal axial passageways. It is made from an electrically insulative material such as one of the common plastics, e.g., nylon, and includes a main body section 16 through which a material flow passageway 18, an electrical path passageway 20, and an air flow passageway 22 extend. The air flow passageway 22 is intersected at the forward end of the gun 10 by a pair of inclined passages 24 and 25 through which the atomizing and fan-shaping air are respectively supplied to the nozzle assembly 13.

Figures 3, 4, 5:
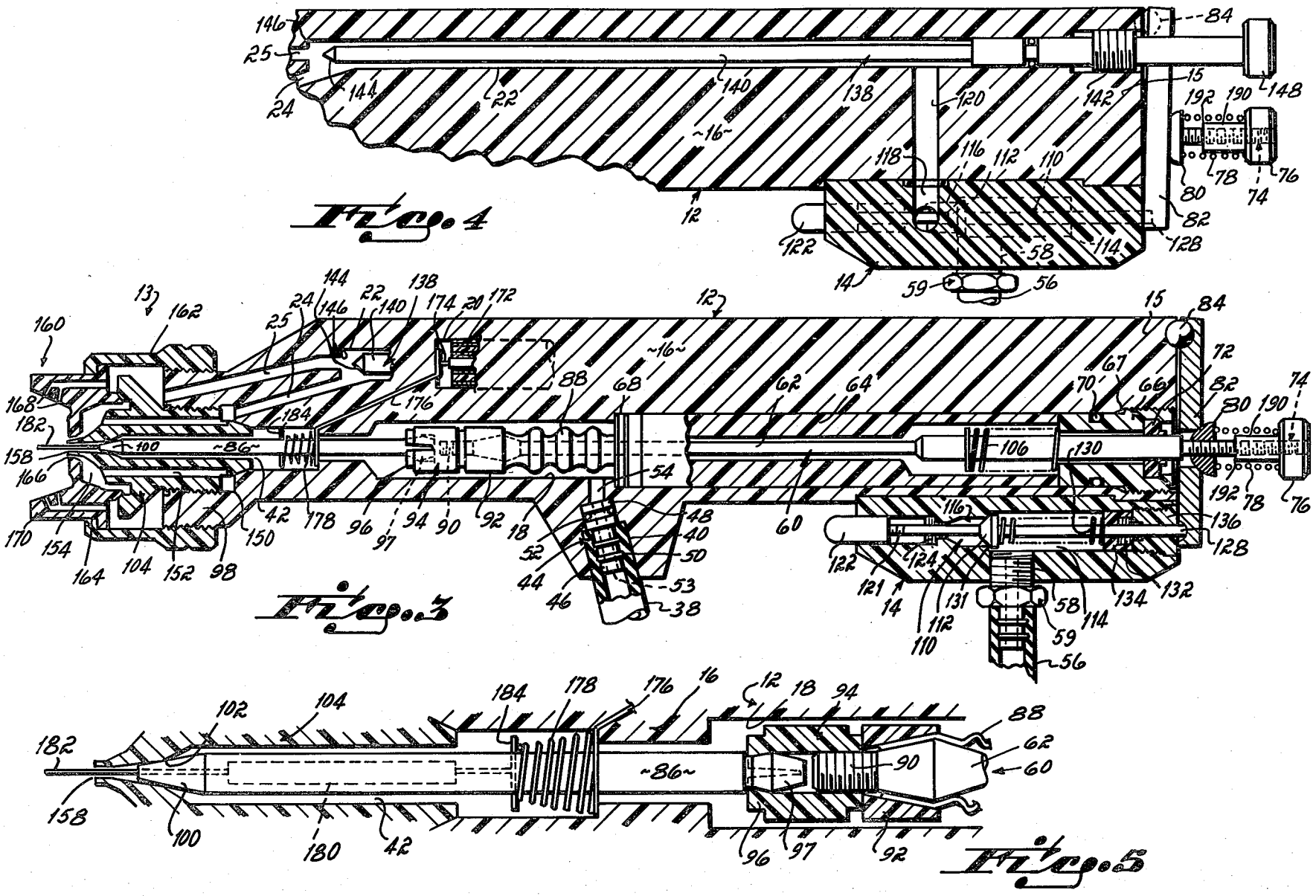
FIG. 3 is a cross sectional view of a portion of the gun shown in FIG. 1.
FIG. 4 is a cross sectional view of the portion of the barrel assembly of the gun of the present invention on a plane spaced from that of FIG. 3 showing the air flow passageways through the barrel.
FIG. 5 is an enlarged view of a portion of FIG. 3 showing the material flow control valve needle and its connection to the pull rod.

The handle assembly 11 is made from a metal casting, for example, die cast aluminum. It is relatively thin-walled, e.g., of $\frac{1}{8}''$ wall thickness and it does not include any internal bores or passageways. The handle 11 is formed of two like half shells 27 and 28 which are attachable to each other and the rear end 15 of the barrel assembly 12 by means of screws 30. The handle assembly 11 serves no function other than to provide a grip for the gun. An adapter 32 is mounted at the butt end of the handle assembly 11. Paint or other spray material which may be in the nature of a coating or a varnish or a lacquer (referred to in regard to this invention generically as paint) is supplied to the gun under pressure from an external tank or reservoir (not shown) through a hydraulic hose 34 connected to a fluid passage 36 extending through the adapter 32. A tube 38 is connected between the adapter and an inlet passage 40 in the underside of the barrel assembly 12. The inlet passage 40 in turn communicates with the annular axial passageway 18 in the barrel 12. The passageway 18 in turn communicates at its forward end with a central annular axial passage 42 in the nozzle assembly 13 (FIG. 3). The passages 18 and 42 are substantially axially aligned. A trigger 43 indirectly operates a needle and seat valve assembly in the passage 42 for controlling the flow of fluid out of the nozzle 13, as hereinafter described in detail.

The material conveying tube 38 extending between the adapter 32 and the inlet passage 40 in the barrel 12 is formed of a suitable plastic material such as Teflon. The connection of the tube 38 to both the adapter 32 and inlet passage 40 is made by a pair of like fittings 44. Referring to FIG. 3, the fitting at the inlet passage 40 will now be described, it being understood that the fitting at the adapter 32 is identical. The fitting 44 comprises an annular member having a smaller diameter end 46 receivable in the tube 38 and a larger diameter end 48 receivable in the inlet 40. The smaller diameter end 46 is of a diameter approximating the inside diameter of the tube 38 and includes a pair of spaced annular ribs 50 of larger diameter such that the end 46 is pressed into the end of the tube 38 prior to assembly of the tube in the position shown in FIGS. 1 and 3. The larger diameter end 48 of the fitting 44 includes an annular groove which receives an O-ring seal 52. In connecting the tube 38 to the barrel, the end of the tube with the fitting end 46 pressed in it is inserted into the inlet 40. On insertion, the end of the tube 38 is compressed between the wall of the inlet opening 40 and the annular ribs 50 to hold the tube in place. The O-ring 52 forms a fluid seal. The fitting 44 has a through opening 53 permitting flow of paint from the tube 38 through a short passage 54 in the barrel 16 and then into the passageway 18. In accordance with the objectives of the invention, this connection is economical to manufacture and easy to make.

Figure 2:
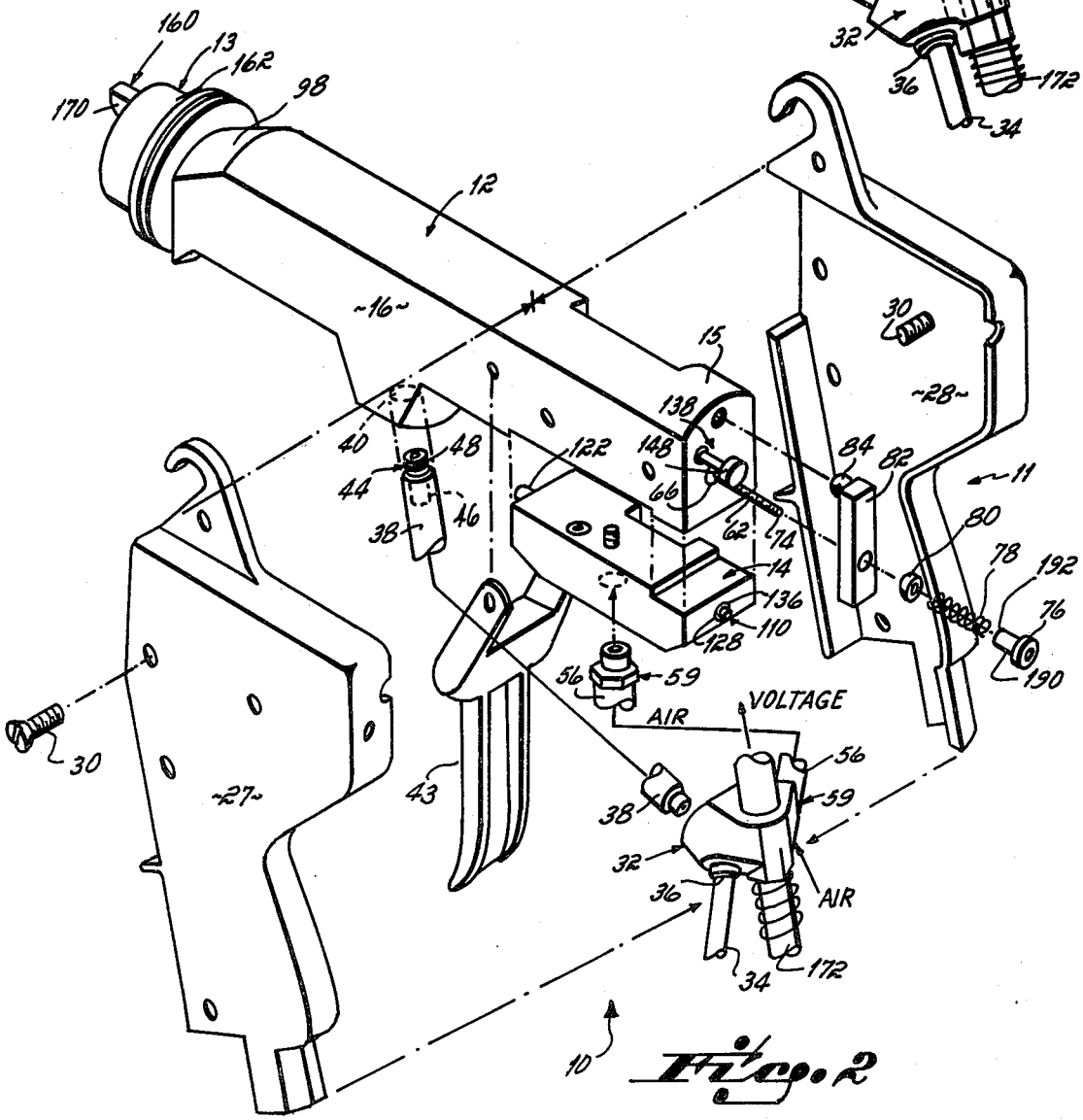
FIG. 2 is an exploded view of the gun shown in FIG. 1.

An air hose (not shown) is also connected to the adapter 32 (FIG. 2) by suitable couplings and communicates through an air flow passage in the adapter with a plastic tube 56, e.g., one made of nylon, which extends between the adapter 32 and an inlet port 58 in the air valve module 14. The tube 56 is contained between the handle halves 27 and 28 and is attached at both ends by fittings 59 similar to fittings 44 described above, but having the larger end threaded into the module 14 and adapter 32.

The flow of paint through the axial flow passageways is controlled by a control rod assembly 60. The control rod 60 comprises a pull rod 62 mounted in a packing cartridge 64 which is inserted from the rear of the barrel 12 and held in place by a retainer 66 threaded into a counterbore 67 in the rear end 15 of the barrel 12. Leakage of material through the rear of the gun is prevented by a seal 68 at the forward end of the cartridge 64 and an O-ring 70 in the retainer 66. The rearward end of the pull rod is supported in the retainer 66 by a rod wiper 72 and terminates in a threaded end portion 74 extending out of the barrel 12. An adjusting nut 76 is threaded onto the end 74 and a spring 78 is compressed between the nut 76 and a member 80 which in turn is spring loaded against a lever 82. The lever 82 is pivotable on a ball 84 captured between the lever and the end of the barrel. The adjusting nut permits adjustment of a needle 86 attached to the forward end of the pull rod 62, as explained hereinafter.

A flexible bellows seal 88 at the forward end of the pull rod 62 permits the pull rod to slide axially in a forward and rearward direction. The preferred form of bellows seal is described in detail in U.S. Pat. No. 4,079,894, assigned to the assignee of this invention. That description is incorporated herein by reference, and those skilled in the art are referred thereto for the details of its construction and operation. The pull rod 62 terminates at its forward end in a threaded end portion 90 which is just forward of a ferrule 92 securing one end of the bellows 88 to the pull rod 62 (FIG. 5).

Attached to the forward end of the pull rod is the needle 86. The needle is attached by means of a plastic nut 94 which is threaded at one end on the threaded end 90 of the control rod 62 and at its other end is split in a radial direction to provide a resilient, expandable end portion 96 receiving a knobbed end 97 of the needle 86 whereby the needle may be snapped into and out of the nut 94. In assembly of the gun, the control rod 62 with the nut 94 threaded on the forward end 90 thereof is inserted into the bore 67 in the barrel 12 from the rear of the barrel. The needle 86 is then inserted through the forward end 98 of the barrel 12, end 97 first, and snapped into the nut 94. The nozzle assembly 13 is then screwed into place. The needle is removed simply by reversing this procedure.

The needle 86 terminates at its forward end at a coned-shaped tip 100. The cone tip 100 cooperates with an internal seat 102 in a fluid tip portion 104 of the nozzle assembly 13 to form a needle and seat valve assembly actuable by the pull rod 62. The mounting of the rear end of the needle to the forward end of the pull rod by means of the nut 94 permits the needle a limited degree of movement from the center axis of passage 18 whereby the needle can align and seat itself on the seat 102 in the nozzle. That is, when the nozzle 13 is screwed onto the end of the barrel, the seat 102 and the needle tip 100 engage aligning the tip on the seat by virtue of the movement of its rearward end 97 in the nut 94. Furthermore, the needle is rotatable within the nut 94. Thus, when the nozzle is either placed on the barrel assembly or taken off, the needle is not placed under torque by engagement with the nozzle. Thus, no external forces are placed on the needle which could cause it to wear or score or to fracture the bellows seal 88. A compression spring 106 urges the control rod assembly 60 forwardly to a normal valve closed position (FIG. 3).

The air valve module 14 whch controls air flow from the inlet 58 to the air passageway 22 in the barrel includes a trigger actuated valve stem 110 and valve sealing element 112 which is effective to open and close communication between an air inlet chamber 114 and air outlet chamber 116. As may be seen in FIGS. 3 and 4, the inlet 58 communicates with the chamber 114, and there is an air outlet port 118 between the chamber 116 and a vertical passageway 120 in turn communicating with the air flow passageway 22 through the barrel of the gun. The valve stem 110 has one end 121 extending toward the forward end of the gun on which a nut 122 is threaded. A seal 124 seals this end of the valve stem. The nut 122 on the end of the valve stem abuts the trigger 43 in the normal valve closed position (FIG. 1) while the opposite end 128 of the valve stem engages the lever 82. The valve stem and sealing element 112 are spring loaded by means of a compression spring 130 to a normal valve closed position as shown in FIG. 3, wherein the element 112 seats on a valve seat 131. An internal seal 132 and seal holder 134 seal the rearward end of the air valve module to preclude leakage of air from the chamber 114. A retainer 136 threaded into the module 14 supports the end 128 of the valve stem 110 and permits access to the interior of the module.

Air flow in the passageway 22 of the barrel 12 is controlled by the trigger actuated air valve 14. This provides both atomizing air and the fan-shaping air. An additional fan air control valve 138 is provided (FIG. 4). This valve includes a single valve plunger 140 which is threaded into a counterbored internally threaded end 142 of the passageway 22. Its forward end 144 is tapered and is engageable with a tapered seat 146 to adjust or close air flow through the passage 25. This adjustment is made by nut 148 at the rear of the gun which adjusts the plunger 140 in a forward and rearward direction.

Referring to FIG. 3, the nozzle assembly 13 will be described. A preferred form of the nozzle assembly 13 is shown in the above-mentioned co-pending application Ser. No. 971,514, assigned to the assignee of this invention, and that disclosure is incorporated herein by reference. In general, the nozzle assembly is made of electrically non-conductive material such as Delrin. Delrin 500 and 550 are presently preferred materials of construction. The nozzle 13 has a fluid tip 104 which is threaded at its rear into a counterbore 150 in the forward end 98 of the barrel 12. The fluid tip 104 has a number of circumferentially spaced axial passages 152 which open at the rear into the counterbore 150 to communicate with the air passage 24 such that atomizing air passing into the passage 24 may enter and pass through the axial passage 152 in the fluid tip and into an internal chamber 154 surrounding the forward end of the fluid tip. The fluid tip also includes the central axial passage 42 communicating with the material flow passage 18 in the barrel portion of the gun for supply of paint via the hoses 34 and 38 from the tank or reservoir.

The forward end of the fluid tip terminates in a nozzle having a small diameter orifice 158 through which the paint is emitted. The fluid tip further includes the coned-seat 102 formed inside the nozzle close to the discharge orifice 158.

An air cap 160 surrounds the forward end of the fluid tip 104. The air cap 160 is mounted to the gun by means of annular retaining ring 162 which is threaded over the externally threaded section 98 of the barrel at one end and at its other end there is an annular lip 164. The retaining ring although rigid is sufficiently flexible at the lip 64 to permit the air cap 160 to be snapped into position with the lip engaging a wall in an annular groove in the outside surface of the air cap such that the air cap is securely retained and sealed against escape of air to the atmosphere.

Flow of the atomizing air is through openings 166 close to the orifice 158, and flow of the fan-shaping air is through openings 168 in air horns 170 which communicate with the passage 25.

As may be seen, the needle and valve seat 100, 102, the discharge orifice 158 and the pull rod 62 are all axially aligned and in line with a single material passageway 18 through the barrel of the gun. Further, the valve seat 102 is very close to the discharge orifice 158 thereby providing more clean operation, there being very little paint retained in the gun downstream of the valve when the valve is closed. In addition, the valve is readily accessible for inspection, maintenance and repair. Thus to service the valve, it is merely necessary to remove the retaining ring 162 and air cap 160 and unscrew the fluid tip 104 from the barrel 12. Replacement of the valve if worn or damaged is likewise easily accomplished merely by replacing the fluid tip portion of the nozzle.

A high voltage source of electrical energy is supplied to the gun by a cable 172 from an external electric power pack (not shown). The high voltage cable 172 connects into the adapter 32 and continues through the handle assembly 11 and the passage 20 which extends through the barrel 12. In a presently preferred form of the invention, the high voltage electrical cable comprises a core of alternating solid, non-brittle resistors and flexible dielectric material. This cable is described in U.S. Pat. No. 4,103,276, assigned to the assignee of this invention, and that disclosure is incorporated herein by reference. The cable is cut and inserted into the barrel of the gun such that at the extreme forward end of the passageway 20 a resistor 174 is exposed. This resistor 174 is connected to a wire 176 which in turn engages a spring 178 mounted on the needle 86. The spring 178 serves to provide electrical connection between the end of the cable 172 and a resistor 180 in the forward end of the needle 86. The forward end of the resistor 180 is electrically connected to a thin, stainless steel wire electrode 182 extending through the discharge orifice 158 of the fluid tip 104. This electrode charges the atomized paint emitted from the nozzle assembly 13. In one presently preferred embodiment, the electrode is rounded having a diameter of 0.025 inch and a length of 0.69 inch. The electrode protrudes beyond the end of the nozzle by 0.27 inch. The resistor 180 and electrode 182 may be either molded into the needle or inserted into an internal cavity or bore in a preformed needle. In either case, the material forming the needle protects the resistor and electrical connection from chemical attack and abrasion from the coating materials passing through the passage 158. The other end of the resistor 180 in in contact with a metallic pin 184 passing through the needle. The pin 184 in turn is in contact with the conical spring 178 contacting the wire 176. Accordingly, the conical spring 178 and pin 184 cooperate to form means electrically connecting the cable 172 with the resistor 180 while permitting axial sliding movement of the needle to open and close the valve. The path of high voltage electrical energy from the cable is thus through the wire 176, the conical spring 178, the pin 184 and the resistor 180 to the charging electrode 182. The resistor 180 thus lies in series in the high energy electrical path and lies forwardly or "downstream" of all the conductive components of the gun other than the charging electrode 182.

As set forth above, the nozzle is substantially non-conductive, being made of Delrin which is substantially non-conductive material, except for the electrode itself. Thus, the amount of electrically conductive material in the forward portion of the gun forwardly or downstream of the blocking resistor 180 in the nozzle is only the electrode 182 itself. Thus, the wire 176, spring 178, and pin 184 are all rearward or"upstream38 of the blocking resistor 180. Thus, the electrically conductive components at the forward end of the gun downstream of the resistor which would otherwise prevent high, undamped electrical capacity have been greatly reduced so as to reduce the availability of capacitively stored energy undamped by a resistor. The resistor 180 is commercially available. The value of the resistor will depend on various factors. In an actual device designed for operation and up to 120 kv (open circuit), the value of the resistor 180 in the nozzle is 12 megohms while the value of the resistors in the cable 172 are 20 megohms spaced such that there are ten resistors 1⅜ inches long in a 25 foot length of cable. The value of the resistor 180 in the nozzle in combination with the resistor 174 in the cable 172 in the barrel 12 cooperate to damp out the effects of electrical components in the gun such as conductor springs, pins, etc.

Operation

To operate the spray gun of the present invention, the operator points the gun at the object to be coated and squeezes the trigger 43 thereby moving it rearwardly. Rearward movement of the trigger 43 in turn causes rearward sliding movement of the valve stem 110 of the air valve module 14 by virtue of the engagement of the trigger 43 with the nut 122 on the end 121 of the valve stem 110. Movement of the valve stem 110 lifts the sealing element 112 off its seat 131 opening communication between the air inlet port 58 and air outlet port 118 to the air passageway 22 extending through the barrel 12. At the same time, the end 128 of the valve stem 110 mechanically engages the lever 82 causing it to pivot rearwardly about the ball 84. The adjusting nut 76 includes a forwardly extending sleeve portion 190. Pivoting of the lever 82 causes the member 80 to compress the spring 78. When member 80 comes into contact with the end 192 of the sleeve portion 190, further pivoting of the lever 82 retracts the pull rod 62 against the bias of spring 106 which in turn retracts the coned-shaped tip 100 of the needle 86 from the valve seat 102 immediately behind the material discharge orifice 158 allowing the paint in the passageway 18 to flow around the tip and out the discharge orifice. The connection between the valve stem 110 of the air valve module 14 and the control rod 60 is a lost motion connection because of the gap between the element 80 and the end 192 of the sleeve 190. As a result of this lost motion connection, the opening of the material flow valve 100, 102 does not occur simultaneously with the opening of the air valve 112, 131 but rather slightly thereafter. This permits the atomizing and fan-shaping air to come on before the paint is released through the discharge orifice 158. This initial flow of air tends to clean the nozzle end of the gun before the flow of paint therethrough and assures that the initial flow of paint will be atomized.

The ratio of paint flow to air flow can be varied by adjusting the nut 76 to vary the size of the gap between member 80 and the end 192 of the sleeve 190. That is, the degree of rearward movement or "pull" of the needle 86 can be decreased to close down the opening between the tip 100 and seat 102 by rotating the adjusting nut 76 in a counterclockwise direction (as viewed from the rear of the gun). This increases the spacing between member 80 and the sleeve thereby increasing the lost motion and shortening the distance of permitted rearward movement of the control rod assembly 60. The size of the opening in the nozzle may be increased by turning the adjusting nut 76 in a clockwise direction (again as viewed from the rear of the gun) to decrease the lost motion and thereby increase the degree of rearward pull of the control rod. This adjustment permits the operator to adjust the paint flow at the gun rather than having to go to the paint source.

When the trigger 43 is released, the spring 130 moves the valve stem 110 forwardly until the valve element 112 seats on seat 131 thereby cutting off the flow of air to the nozzle. On release of the trigger 43 and on forward movement of the valve stem 110, spring 106 moves the control rod assembly 160 forwardly until the tip 100 engages the valve seat 102 to close the material flow valve thereby stopping the flow of paint out of the nozzle. The return of the control rod assembly 60 on release of the trigger 43 to a valve closed position occurs slightly ahead of the closing of the air valve by virtue of the lost motion connection between the valve stem 110 and the pull rod 62 through the lever 82. Thus, the flow of air continues a short time after cessation of flow of paint. This allows the nozzle to clean itself when the painting operation is stopped and assures that the last increment of paint issuing from the gun is atomized.

Although the invention has been described in terms of certain preferred embodiments, those skilled in the art will recognize that other forms may be adopted within the scope of the invention.

I claim:

1. An electrostatic spray gun comprising:

a substantially electrically non-conductive barrel having a fluid conduit therein adapted to be connected to a source of fluid coating material under pressure, and an air conduit, a nozzle made from a substantially non-conductive material on the forward end of said barrel, said nozzle having a fluid discharge opening effective to project coating material therefrom, fluid valve means for controlling the flow of coating material through said discharge opening, and an air opening communicating with said air conduit for dispensing air effective to atomize said coating material issuing from said discharge opening, charging means for imparting an electrical charge to said coating material, a removable air valve module mounted to and externally of the rear end of said barrel including an air valve and movable valve closure means for selectively opening and closing said air valve to selectively supply said air conduit with atomizing air, a relatively thin-walled handle shell attached to the rear end of said barrel, said handle shell surrounding said rear end of said barrel and said air valve module without said air valve module being physically supported by said handle shell permitting ready access to said air valve module by removing said handle shell, and means for moving said movable valve closure means for selectively opening and closing said air valve and for opening said fluid valve means on opening of said air valve and closing said fluid valve means before closing of said air valve.

2. The electrostatic spray gun of claim 1 wherein said fluid valve means comprises a pull rod disposed generally centrally of said fluid conduit in said barrel and a needle attached to the forward end of said pull rod, said needle being operative to engage at its forward end a valve seat disposed in said nozzle rearwardly of said discharge opening, said discharge opening being generally axially aligned with said fluid conduit in said barrel.

3. The spray gun of claim 1 wherein said means for moving said movable valve closure means and for opening said fluid valve means comprises a trigger for moving said movable valve closure means and a lost motion connection between said movable valve closure means and said fluid valve means.

4. The electrostatic spray gun of claim 1 wherein said valve closure means of said air valve module extends rearwardly out of said air valve module and wherein said gun further comprises a pivotal lever, the end of said valve closure means extending out of said air valve module engaging said lever on opening of said air valve to in turn open said fluid valve means.

5. The electrostatic spray gun of claim 4 wherein said fluid valve means comprises a control rod assembly disposed in said fluid conduit in said barrel terminating at its forward end in a tip adapted to engage a valve seat, the opposite end of said control rod assembly extending out the rearward end of said barrel, said lever being pivotal at one end of said barrel and the other end engaging said end of said valve closure means extending out of said air valve module, the end of said control rod assembly extending out the rear end of said barrel engaging said lever at a point intermediate the ends thereof.

6. The electrostatic spray gun of claim 1 wherein said handle shell comprises a pair of relatively thin-walled half-shells attached to the rear end of said barrel.

7. The electrostatic spray gun of claim 6 wherein said gun further comprises an adapter mounted to the butt end of said handle shell for receiving fluid and air supply means, and fluid and air supply tube means extending between said adapter and said barrel portion of said gun to convey fluid and air to said barrel.

8. The electrostatic spray gun of claim 7 wherein said air supply tube means is disposed between said handle half-shells.

9. The electrostatic spray gun of claim 7 wherein the ends of said tube means are connected to said adapter and to said barrel respectively by a fitting having a through opening generally centrally thereof, said fitting comprising a first portion having a diameter approximating the inside diameter of said tube means and being receivable therein and a larger diameter portion receivable in an opening in said adapter and in said barrel, said first portion including at least one circumferential rib adapted to engage the inner wall of said tube means.

10. An electrostatic spray gun comprising:

a substantially electrically non-conductive barrel having a fluid conduit therein adapted to be connected to a source of fluid coating material under pressure, an air conduit, and a high voltage electrical path, said path having a first end and a second end, said first end being adapted to be connected to a source of high voltage electrical power, a nozzle made from a substantially non-conductive material on the forward end of said barrel, said nozzle having a fluid discharge opening effective to project coating material therefrom, fluid valve means for controlling the flow of coating material through said discharge opening, and an air opening communicating with said air conduit for dispensing air effective to atomize said coating material issuing from said discharge opening, charging means connected to said second end of said high voltage electrical path for applying an electrical charge to said fluid as it issues from said discharge opening, a removable air valve module mounted to and externally of the rear end of said barrel including an air valve and movable valve closure means for selectively opening and closing said air valve to selectively supply said air conduit with atomizing air, a relatively thin-walled handle half-shells attached to the rear end of said barrel, said handle half-sheels surrounding said rear end of said barrel and said air valve module without said air valve module being physically supported by said handle permitting ready access to said air valve module by removing said handle, trigger means operative to engage and to move said valve closure means of said air valve module to open said air valve, and means operatively connecting said valve closure means of said air valve module to said fluid valve means to open said fluid valve means in response to the movement of said valve closure means on opening of said air valve.

11. The electrostatic spray gun of claim 10 wherein said fluid discharge opening of said nozzle is generally axially aligned with said fluid conduit in said barrel.

12. The electrostatic spray gun of claim 11 wherein said fluid valve means comprises a pull rod disposed generally centrally of said fluid conduit in said barrel and a needle attached to the forward end of said pull rod, said needle being operative to engage at its forward end a valve seat disposed in said nozzle rearwardly of said discharge opening.

13. The electrostatic spray gun of claim 10 wherein said fluid valve means comprises a control rod assembly disposed in said fluid conduit in said barrel terminating at its forward end in a tip adapted to engage a valve seat, the opposite end of said control rod assembly extending out the rearward end of said barrel, and wherein said means operatively connecting said valve stem means to said fluid valve means comprises a lever operatively engaging said end of said control rod assembly extending out of said barrel, the connection between said valve stem means and said fluid valve means being a lost motion connection whereby said air valve module opens before opening of said fluid valve means on actuation of said trigger and closes after closing of said fluid valve means on release of said trigger.

14. The electrostatic spray gun of claim 10 wherein said trigger means is attached to said barrel, and wherein said gun further comprises an adapter mounted to the butt end of said handle half-shell for receiving fluid and air supply means, and fluid and air supply tube means extending between said adapter and said barrel portion of said gun to convey fluid and air to said barrel.

15. The electrostatic spray gun of claim 14 wherein said air supply tube means is disposed between said handle half-shells and wherein said fluid supply tube means extends from said adapter to an opening in the underside of said barrel forward of said trigger whereby said fluid supply tube means forms a guard for said trigger.

16. The electrostatic spray gun of claim 10 further comprising at least a first series resistor in said electrical path close to said charging means.

17. The electrostatic spray gun of claim 12 wherein said charging means protrudes from said needle and out said discharge opening and further comprising at least a first series resistor mounted in said needle, said resistor being connected at its forward end to said charging means and at its rearward end to said second end of said high voltage electrical path.

18. An electrostatic spray gun comprising:

a substantially electrically non-conductive barrel portion having a fluid conduit therein adapted to be connected to a source of fluid coating material under pressure, and an air conduit, a nozzle portion made from a substantially non-conductive material having a fluid discharge opening effective to project coating material therefrom, fluid valve means for controlling the flow of coating material through said discharge opening, and an air opening communicating with said air conduit for dispensing air effective to atomize said coating material issuing from said discharge opening, charging means for imparting an electrical charge to said dispersed coating material, a removable air valve module mounted externally of said barrel portion including an air valve and movable valve closure means for selectively opening and closing said air valve, said valve closure means of said air valve module extending rearwardly out of said air valve module, and a pivotal lever mounted to the rear end of said barrel, said end of said valve closure means extending out of said air valve module mechanically engaging said lever on opening of said air valve to in turn open said fluid valve means.

19. An electrostatic spray gun coating apparatus comprising a substantially electrically non-conductive barrel portion having a forward end and a rearward end and having therein a fluid conduit adapted to be connected to a source of fluid coating material under pressure, an atomizing air conduit having an air inlet and an air outlet at said forward end of said barrel, and a high voltage electrical path, said path having a first and a second end, said first end being adapted to be connected to a source of high voltage electrical power, a nozzle portion made of substantially electrically non-conductive material connected to the forward end of said barrel portion and having a generally axial coating material passageway therethrough substantially axially aligned with said fluid conduit in said barrel portion, said fluid passageway terminating at its forward end in a discharge orifice effective to project coating material therefrom, and a plurality of gas flow passageways communicating with said air outlet of said atomizing air conduit in said barrel effective to disperse said coating material issuing from said discharge orifice, valve means in said nozzle comprising a control rod assembly axially slidably movable in said conduit in said barrel and in said passageway in said nozzle and a coned seat formed inside said nozzle close to said discharge orifice, said control rod being formed of an electrically non-conductive material and terminating at its forward end in a coned tip adapted to cooperate with said seat for controlling the flow of coating material through said discharge orifice, the rearward end of said control rod assembly projecting rearwardly out the end of said barrel portion, a removable air valve module mounted externally of said barrel portion comprising an air inlet port, an air outlet port and a valve therebetween, said outlet port communicating with said air inlet of said air atomizing conduit, and movable valve stem means having a closure element mounted thereon for selectively opening and closing said air valve, said valve stem means having a first end protruding forwardly of said air valve module and a second end protruding rearwardly of said air valve module, trigger means operative to engage said first end of said valve stem means and to move said valve stem means to open said air valve, lever means pivotal on the rear end of said barrel portion, said lever means operatively connecting said second end of said valve stem means of said air valve module to said rearward end of said control rod assembly whereby movement of said valve stem means in response to said movement of said trigger means causes rearward movement of said control rod to open said valve means in said nozzle, a handle assembly including a pair of relatively thin-walled half shells attached to the rear end of said barrel and enclosing said air valve module, said handle assembly including an adapter at the butt end thereof for receiving fluid and air supply means and including fluid and air supply tube means extending between said adapter and said barrel portion of said gun, said air supply tube means being disposed between said handle shells, a charging electrode mounted at one end in said forward end of said control rod and protruding from said nozzle orifice, a first series resistor mounted in said forward end of said control rod in said high voltage electrical path passing therethrough, said first series resistor being connected at its forward end to said charging electrode, and means for electrically connecting the other end of said resistor to said second end of said electrical path in said barrel to thereby connect said charging electrode to said source of high voltage electrical power while permitting axial sliding movement of said control rod.

20. The spray gun apparatus of claim 19 wherein the connection between said valve stem means and said control rod is a lost motion connection and wherein the degree of lost motion is adjustable from outside of the gun.

* * * * *

UNITED STATES PATENT AND TRADEMARK OFFICE

CERTIFICATE OF CORRECTION

PATENT NO. : 4,294,411

DATED : October 13, 1981

INVENTOR(S) : Donald R. Hastings et al

It is certified that error appears in the above—identified patent and that said Letters Patent is hereby corrected as shown below:

In column 4, line 4, "in" second occurrence should be --is--.

In column 8, line 34, "upstream 38" should be --"upstream"--.

Signed and Sealed this

*Twentieth* Day of *April 1982*

[SEAL]

*Attest:*

GERALD J. MOSSINGHOFF

*Attesting Officer*

*Commissioner of Patents and Trademarks*